US007992819B2

(12) United States Patent
King

(10) Patent No.: US 7,992,819 B2
(45) Date of Patent: Aug. 9, 2011

(54) THREAD SPOOL AND BOBBIN HOLDER

(75) Inventor: Feather W. King, Ashland, OR (US)

(73) Assignee: Blue Feather Products, Inc., Ashland, OR (US)

( * ) Notice: Subject to any disclaimer, the term of this patent is extended or adjusted under 35 U.S.C. 154(b) by 0 days.

(21) Appl. No.: 12/460,704

(22) Filed: Jul. 22, 2009

(65) Prior Publication Data

US 2011/0017855 A1 Jan. 27, 2011

(51) Int. Cl.
*B65H 75/24* (2006.01)

(52) U.S. Cl. ..... 242/571.4; 242/580; 242/588; 242/592; 242/594.3; 242/597.5; 242/597.8; 242/125.2; 242/129; 242/134; 211/85.5; 223/106

(58) Field of Classification Search ..... 242/570, 242/571.3, 571.4, 571.5, 577.1, 579, 580, 242/587, 587.2, 588, 592, 593, 594, 594.3, 242/594.4, 594.5, 594.6, 597, 597.5, 597.6, 242/597.7, 597.8, 129, 129.5, 130, 130.3, 242/130.4, 131, 134, 139, 125–125.3; 211/85.5; 248/309.2; 112/302; 223/160, 107, 108, 223/109 A, 109 R, 106
See application file for complete search history.

(56) References Cited

U.S. PATENT DOCUMENTS

| | | | | |
|---|---|---|---|---|
| 462,702 | A | 11/1891 | Haas | |
| 470,328 | A | 3/1892 | Harlow | |
| 1,386,556 | A * | 8/1921 | De Vito | 242/131 |
| 1,405,554 | A | 2/1922 | Northcraft | |
| 1,508,105 | A | 9/1924 | Kamla | |
| D146,869 | S | 6/1947 | Olsen | |
| 2,431,423 | A | 11/1947 | Robbins | |
| 2,944,761 | A | 7/1960 | Best | |
| 3,491,893 | A | 1/1970 | Morris | |
| 3,738,590 | A | 6/1973 | Granati | |
| 3,948,396 | A | 4/1976 | Upton et al. | |
| 4,029,241 | A | 6/1977 | Krake | |
| 4,094,415 | A | 6/1978 | Larson | |
| 4,195,739 | A | 4/1980 | Sweet, III | |
| 4,351,458 | A | 9/1982 | Wolfe | |
| 5,694,873 | A * | 12/1997 | Wu | 112/302 |
| 5,727,699 | A | 3/1998 | Gilcrease | |
| 5,913,485 | A | 6/1999 | Bruffett | |
| 6,702,226 | B1 * | 3/2004 | Bowling | 242/597.4 |
| 6,789,771 | B1 | 9/2004 | Shick et al. | |
| 2007/0181738 | A1 * | 8/2007 | Demers | 242/597.8 |

FOREIGN PATENT DOCUMENTS

WO WO 8908732 A * 9/1989

* cited by examiner

*Primary Examiner* — William E Dondero
(74) *Attorney, Agent, or Firm* — Thomas M. Freiburger

(57) ABSTRACT

A thread spool holding device has a plastic base plate that holds a series of preferably soft plastic spindles that can be introduced or removed from the base and can be arranged as needed by sliding along a slotted track of the base. Each spindle can hold a threaded spool and has a cross sectional configuration for gripping the center hole of the spool. The spindle ends can also hold a bobbin in tandem with a thread spool.

19 Claims, 2 Drawing Sheets

THREAD SPOOL AND BOBBIN HOLDER

BACKGROUND OF THE INVENTION

This invention concerns sewing supplies and equipment.

Seamstress work, using one or more sewing machines, usually requires a collection of spools of different thread, as well as bobbins for the various spools, often holding thread particular to a spool. The spools and bobbins are often switched frequently on a sewing machine.

Quite a number of devices have been conceived to accommodate multiple spools and/or bobbins for retrieval and storage in sewing. These come in a wide variety of forms. See, for example, U.S. Pat. Nos. 5,913,485, 5,727,699, 4,351,458, 4,195,739, 4,029,241, 3,948,396, 3,738,590, 2,944,761, 1,508,105, 1,405,554, 470,328, 462,702 and Des. 146,869. See also U.S. Pat. Nos. 6,789,771, 4,094,415, 3,491,893 and 2,431,423 showing devices for holding other articles not related to sewing, but with certain mechanical features having some pertinence to the invention.

There is a need for a convenient, compact and versatile spool holder, preferably also for bobbins, to keep these items together and readily available for retrieval and storage.

SUMMARY OF THE INVENTION

The spool holder of the invention is simple in concept but highly versatile, compact and efficient in use. The holder comprises a base plate or rack that is narrow and elongated and formed of molded plastic material, preferably a material that is relatively rigid but with some degree of give. To this base plate are attached, via an elongated slot through the length of the base plate, a series of preferably rubbery spindles, each with a stem long enough to hold a thread spool and optionally a bobbin stacked at the end of the thread spool. The spindles have heads with a peripheral groove, formed by a pair of axially spaced apart rubbery discs, and the base plate has a hole, basically keyhole-shaped to receive the heads of inserted spindles. The spindles can then be entered into the slot, to be slid along the slot or track to desired positions.

The spindles preferably can be inserted from either face of the base plate, so that their stems extend at right angles from the base plate in either direction, allowing dense storage of thread spools. Each spindle stem is at least slightly laterally compressible (in some portion of its length) so as to exert a force within the core of each thread spool (and bobbin) when the thread spool is forced down over the spindle, slightly compressing and deforming some portion of the spindle. For this purpose the spindle stems in one embodiment have a U-shaped cross section, and can have a thickened region near the head. Spools and bobbins are held in place by frictional engagement with the spindle.

It is thus among the objects of the invention to enable versatile, dense storage of thread spools of different sizes, with a device that allows the user to adjust positions of spool-engaging spindles as desired, for efficient storage and retrieval of spindles, and preferably also bobbins. These and other objects, advantages and features of the invention will be apparent from the following description of a preferred embodiment, considered along with the accompanying drawings.

Description of Preferred Embodiments

Figure 1:
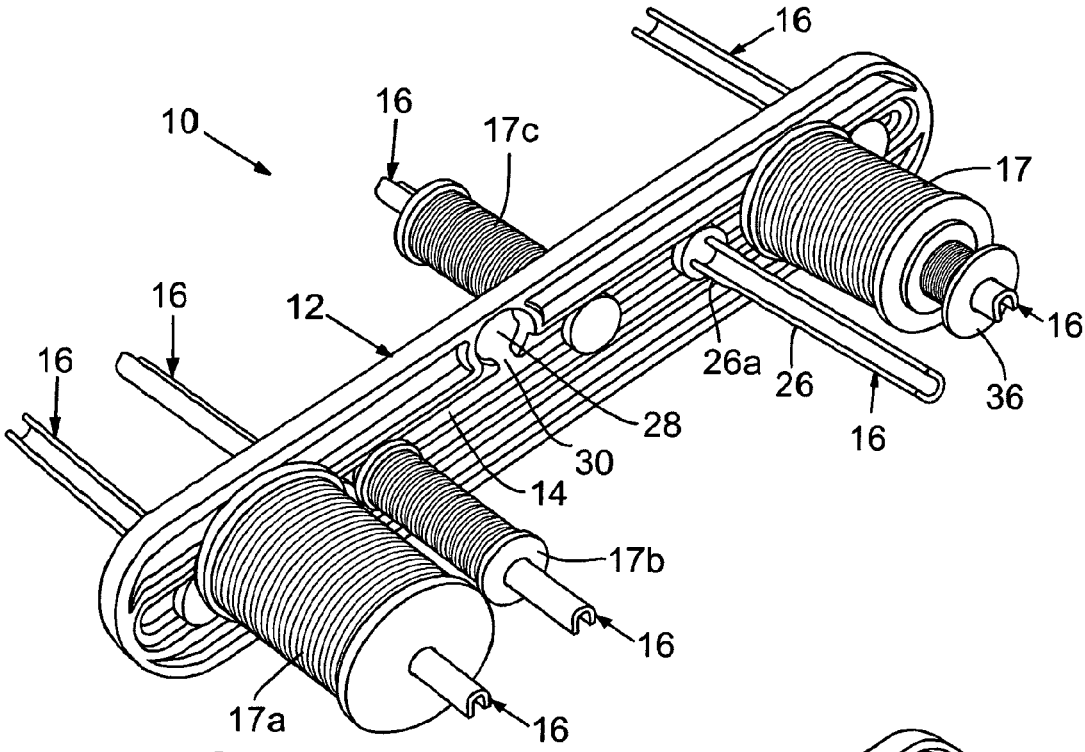
FIG. 1 is a perspective view showing a thread spool holder according to the invention, with spindles and spools attached.
Figure 5:
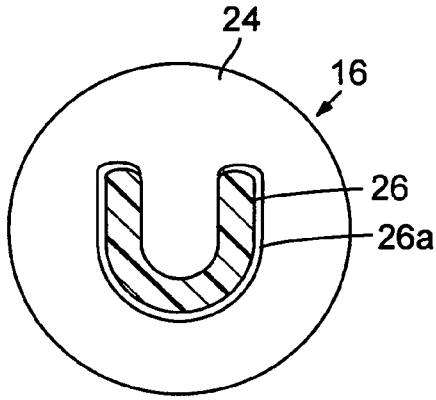
FIG. 5 is a cross section view showing the configuration of the stem of the spindle, taken in the plane 5-5 in FIG. 4.
Figure 4:
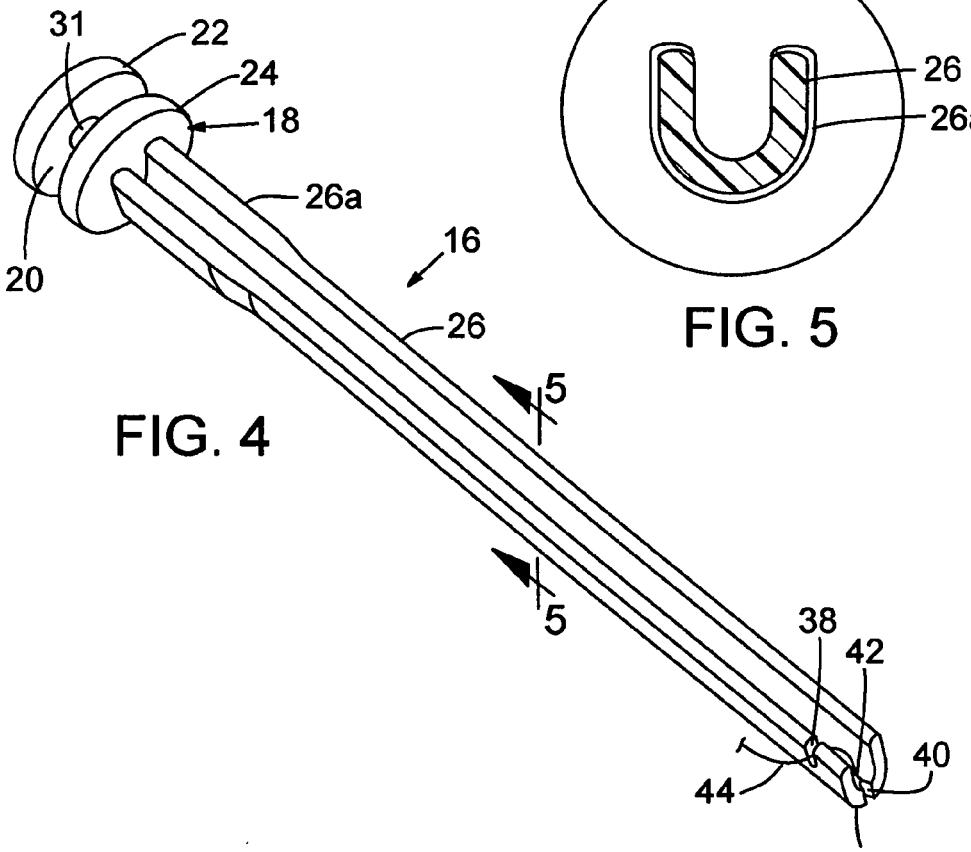
FIG. 4 is detail view in perspective showing one of the spool holder spindles.

In the drawings, FIG. 1 shows a spool and bobbin holder device 10 of the invention, including a base plate or rack 12 formed of molded plastic material, which may be injection molded. This rack is elongated, and may be about eight to nine inches in length, more broadly between about six inches and fifteen inches in length. Other lengths can be selected for particular applications. As the drawing shows, the base plate has an elongated slot 14 within which are engaged a series of spool holder spindles 16, which can be formed of a rubbery plastic material such as urethane. In one form the spindles are made from a thermoplastic elastomer, about 85durometer on the A scale. The rack or bar 12 may be, for example, ABS 109 on the R scale. The spindles hold thread spools 17. An individual spindle 16 is shown in FIG. 4. The spindle 16 has a grooved head 18, with a groove 20 which preferably is annular, defined between two integral discs 22 and 24 on either side of the groove 20. An integral stem or shaft, not seen in the drawings, extends axially between these discs. As shown in FIGS. 4 and 5, the spindle stem 26 in this preferred embodiment is generally U-shaped. This enables inward compressibility of the stem (to smaller effective diameter) for a spool 17 pushed onto the spindle, or for a bobbin. The spindle 16 is integrally molded and is somewhat flexible. It has a spindle stem 26 that extends essentially linearly from the head 18.

As shown in FIG. 1, a significant number of thread spools 17, 17*a*, 17*b*, 17*c*, etc. can be attached onto the device. In fact, the thread spools can be quite densely packed, into contact with one another as shown at 17*a* and 17*b*, and the spindles 16 can be arranged as closely as permitted by the width of the spools. This position adjustment feature of the device, along with the ability to arrange the spindles 16 to extend in both opposed directions, each essentially at right angles to the plane of the base plate or bar, allows very dense storage of thread spools on the device when desired.

Figure 2:
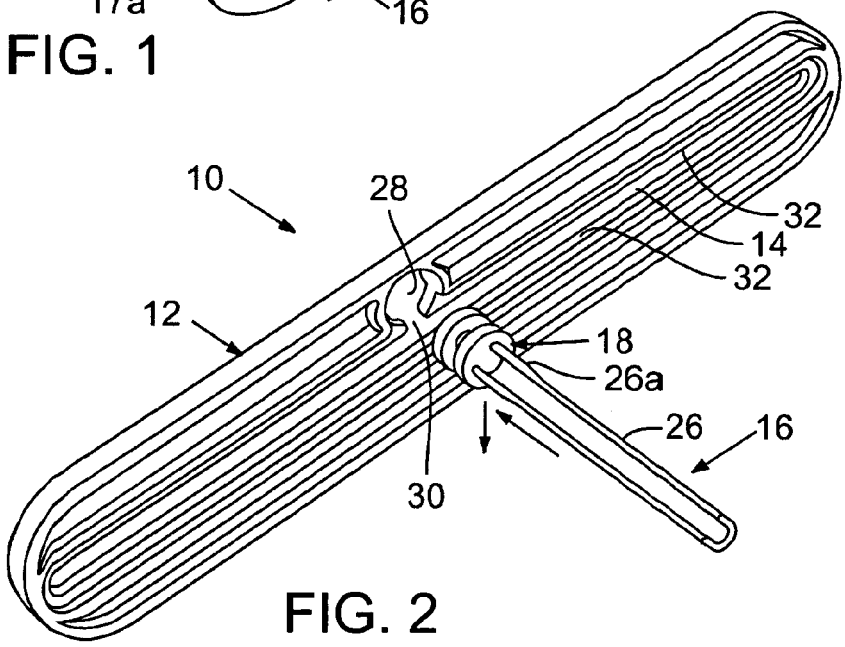
FIG. 2 is a perspective view illustrating the manner in which a spool holder spindle is assembled into a base plate of the device.

FIG. 2 demonstrates that the spindles 16 are assembled into the slot 14 of the base plate or rack 12 by inserting the spindle head 18 into a generally keyhole-shaped opening 28 in the base plate, alongside and contiguous with the slot 14. The keyhole opening may be essentially a circular opening 28 with a narrow adjoining channel 30 leading into the slot 14. The channel or gap 30 is just wide enough to allow the shaft 31 (see FIG. 4) at the axial center of the head 18 to slide through when pushed in that direction by a user. Although the spindle heads 18 and the opening 28 are shown as circular, they could be other shapes, such as elliptical, square or rectangular. Circular is preferred, but the important feature is that the head be passed into an access opening which may be a similar shape to the head but in any event allows the head to pass through. Also important is that the gap 30 be narrow so as to engage the head while allowing its central shaft to slide through with one of the head discs 22, 24 adjacent to and engaged with each opposed face (front and back as seen in FIG. 2) of the base plate. The circular shape provides for adequate gripping of the grooved head onto the plate edges 32, while allowing for relatively easy sliding of the spindle via its head 18 along the length of the slot for repositioning the spindle as desired. Non-circular head shapes will operate but may experience binding more than the circular shape, which produces less contact with the plate edges 32 and allows for some rolling when sliding, avoiding binding.

Although the opening 28 for the spindle heads is shown set off to one side of the slot 14, it could be otherwise positioned. For example, the hole could be centrally positioned on the slot, straddling both plate edges 32, although this would require more care when an engaged spindle is slid past the opening, so as not to unintentionally dislodge the spindle. Also, such location of the hole would have the disadvantage of preventing the positioning of a spindle at that location when needed for storing thread spools densely on the device. The hole could be positioned at either extreme end of the slot, although again, this would eliminate those positions for retaining a spindle.

Figure 3:
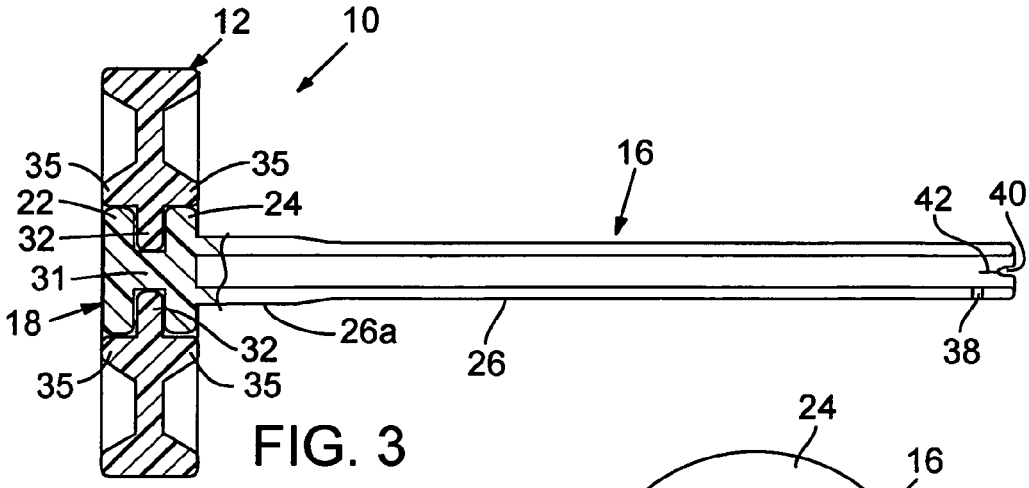
FIG. 3 is a cross section view through the base plate, showing retention of a spindle.

FIG. 3 shows the device of the invention in cross section, and illustrates a spindle 16 assembled into the slot 14 of the base plate or rack 12. This cross section shows in more detail how the spindle is retained in place. The head 18 of the spindle straddles the slot 14, with the plate edges 32 of the slot engaged in the annular groove of the spindle head 18. The two discs 22 and 24 that form the head are shown on opposed sides of the base plate 12 and of the slot plate edges 32. The spindle stem 26 extends out at right angles from the plane of the rack or plate 12. FIG. 3 also illustrates margins or border ridges 35 preferably bordering the slot region and spaced apart so as to define a track that closely fits to the head of the spindle. The track provides greater stability.

FIGS. 3 and 4 also show a feature of a preferred embodiment for retaining the thread end from a thread spool or a bobbin retained on a spindle. Although no thread spool or bobbin is shown in FIG. 3 or 4, these views show a side notch 38 in the side of one leg of the U-shaped spindle stem 26, and also a similar notch 40 preferably included in the bottom of the U at the outer end of the spindle 26. The notch 38 may be, for example, roughly ⅛ inch back from the end of the spindle 26. The depth of each notch is minimal and can be, for example, 1 mm or less, and the width of each notch can be approximately similar. At the bottom of the end notch 40 is a slit in the plastic material of the U-shaped spindle stem 16, this slit being shown at 42. FIG. 4, though not showing a spool or bobbin, schematically indicates the manner in which the notches and slit are used. A thread end 44 is shown, the end of a spool or a bobbin of thread and extending off the spool or bobbin in the same direction as the thread is wound on the spool or bobbin. The thread is placed into the notch 38 and then, within the U shape of the spindle stem 26, is brought up to the end notch 40 and pulled downwardly to engage the thread in the slit 42 to firmly retain the thread end in place. The slit 42 can be, for example, about ⅛ inch deep. Since the bobbin (or spool) is held firmly on the spindle, the thread end will be retained securely against unwinding.

FIG. 5 shows a spindle 16 in cross section, as seen generally in the plane 5-5 in FIG. 4. Another feature of the invention, as seen in FIG. 5 and also in FIG. 3, is that the stem 26 of the spindle 16 in a preferred embodiment tapers to a larger dimension, i.e. a larger effective diameter, in a base portion **26*a* adjacent to the head 18. This provides for a tighter, more positive gripping of the thread spool by its center core as the spool reaches the end of the spindle stem and is positioned close to or in contact with the base plate. In fact, the spindle stem 26 can be of a dimension to allow thread spools to freely slide over the outer regions of the stem, while becoming firmly engaged only at the base of the stem. The outer end of the spindle, although a thread spool might fit loosely over it, can firmly engage a bobbin 36 as shown in FIG. 1**. The length of the spindles in a preferred embodiment preferably is sufficient for storing a bobbin outboard of a spool. Bobbins generally have a slightly smaller core diameter than thread spools. The length of the spindle stem is at least about two inches, and preferably, in the case of accommodating bobbins, at least about two and one-half inches and ideally about two and five-eighths inches to two and three-quarters inches. More broadly the length of the spindle stem should be in the range of about two inches to three inches, and preferably about two and one-half inches to three inches for accommodating bobbins.

The spindles can be used independently of the base plate or rack, to keep spools and bobbins together.

The invention encompasses variations to the preferred embodiment described. Although the spindles may be formed of a somewhat rubbery elastomer material, a harder plastic could be used. A surface friction characteristic is preferred. The base plate or rack 12 could be other than straight as shown; its elongated slot could be curved, compound-curved, or even in a circle or ellipse, interrupted with crossbars to hold the base plate together.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A thread spool holding device, comprising:

a base plate, elongated in shape and having an elongated slot, a series of spindles formed of unitary plastic, flexible, deformable material, each spindle having a grooved head and an elongated spindle stem extending from the head and configured and sized to compress when a thread spool is pushed over the spindle such that the spindle stem extends into a central cylindrical opening of the thread spool, so that the thread spool becomes gripped on the spindle stem, a hole in the base plate adjacent to and open to the slot, the hole being large enough to receive a spindle head inserted therein and to permit the spindle head to be slid into the slot whereby the grooved head becomes engaged onto opposed plate edges of the slot, the elongated slot being of length sufficient to hold a plurality of spindles, each with a thread spool on the stem, side by side on the base plate, and the grooved heads of the spindles being frictionally engaged on the opposed plate edges so as to allow sliding repositioning by pushing of the spindles along the slot of the base plate by a user, while still gripping the spindle heads and maintaining the spindle stems at essentially right angles to the base plate for holding a series of spools on the series of spindles.

2. The device of claim 1, wherein the base plate and slot are configured to allow the spindles to extend in opposite, 180° -opposed directions from the base plate.

3. The device of claim 1, wherein the spindles are formed of a thermoplastic elastomer, in a hardness range of about 85 durometer on the A scale.

4. The device of claim 1, wherein the spindle stems each have a deformable U-shaped cross section.

5. The device of claim 1, wherein the spindles are of a rubbery material with a high-friction surface.

6. The device of claim 1, wherein the hole in the base plate is generally circular and to one side of the slot, with a narrow channel opening connecting the hole to the slot, the channel opening being of such a width as to allow the grooved head of a spindle to fit closely through the channel.

7. The device of claim 1, wherein the base plate is formed of injection-molded plastic.

8. The device of claim 1, wherein the elongated slot in the base plate is essentially linear.

9. The device of claim 1, wherein the slot in the base plate forms a track, with raised border ridges formed in the base plate and spaced outward from and parallel to the slot so as to define a space just wide enough to receive the heads of the spindles.

10. The device of claim 1, wherein the base plate has a length in the range of about six inches to fifteen inches.

11. The device of claim 1, wherein the spindle stems have a length of at least about two inches.

12. The device of claim 1, wherein the spindle stems have a length of about two and one-half inches.

13. The device of claim 1, wherein the spindle heads are circular and configured generally as two axially spaced apart discs with an integral, axially central post holding the discs together.

14. The device of claim 1, and further including thread spools on at least some of the spindles.

15. The device of claim 14, and further including bobbins retained on outer ends of at least some of the spindles having spool threads, the spindle stems being long enough to extend through a thread spool and a bobbin.

16. The device of claim 15, wherein some of the spindles include a thread end retention feature for anchoring the end of a thread coming off a bobbin.

17. The device of claim 16, wherein the thread retention feature comprises a slit in the end of the spindle, for receiving a thread pulled down into the slit.

18. The device of claim 1, wherein some of the spindles include a thread end retention feature for anchoring the end of a thread coming off a bobbin or spool.

19. The device of claim 18, wherein the thread retention feature comprises a slit in the end of the spindle, for receiving a thread pulled down into the slit, the slit being at the bottom of a notch in the end of the spindle, and wherein the spindle stem has a deformable U-shaped cross section, and including a second notch formed in one side of the U-shaped spindle stem, near the end to receive and guide the thread end on its way to the slit.

* * * * *